US005298960A

United States Patent [19]

Fukuchi et al.

[11] Patent Number: 5,298,960

[45] Date of Patent: Mar. 29, 1994

[54] TONER ADHESION AMOUNT DETECTING APPARATUS FOR AN IMAGE FORMING APPARATUS

[75] Inventors: Masakazu Fukuchi, Hachioji; Shizuo Morita, Tachikawa; Shizuo Kayano, Sagamihara, all of Japan

[73] Assignee: Konica Corporation, Tokyo, Japan

[21] Appl. No.: 59,285

[22] Filed: May 11, 1993

[30] Foreign Application Priority Data

May 27, 1992 [JP] Japan ..... 4-160305

[51] Int. Cl.[5] ..... G03G 15/01

[52] U.S. Cl. ..... 355/326 R; 355/246

[58] Field of Search ..... 355/203, 204, 208, 245, 355/246, 326, 327, 77; 430/32, 42

[56] References Cited

U.S. PATENT DOCUMENTS

| | | | |
|---|---|---|---|
| 4,372,672 | 2/1983 | Pries | 355/208 X |
| 4,796,065 | 1/1989 | Kanbayashi | 355/208 |
| 4,894,685 | 1/1990 | Shoji | 355/246 |
| 5,103,260 | 4/1992 | Tompkins et al. | 355/208 |
| 5,107,302 | 4/1992 | Bisaiji | 355/246 |
| 5,196,886 | 3/1993 | Nakane et al. | 355/246 |
| 5,200,783 | 4/1993 | Maeda et al. | 355/246 |

FOREIGN PATENT DOCUMENTS 2212419A 7/1989 United Kingdom .

OTHER PUBLICATIONS

English language abstract of Japanese patent publication No. JP-A-60 80865 dated May 8, 1985.

*Primary Examiner*—A. T. Grimley
*Assistant Examiner*—Sandra L. Brasé
*Attorney, Agent, or Firm*—Finnegan, Henderson, Farabow, Garrett & Dunner

[57] ABSTRACT

A method for determining toner adhesion amounts of plural color toners on a photoreceptor. The method includes the steps of: (1) forming plural reference latent images, each of which is corresponding to a respective component color image of a reference toner image; (2) developing the reference latent images, each of which is developed with a respective color toner of the plural color toners, so that developed reference latent images are superimposed, each at a time, on the photoreceptor to form the reference toner image; (3) detecting the toner adhesion amounts of the plural color toners by detecting the reference toner image every time when one of the developed reference latent images is superimposed on the same portion of the photoreceptor; and (4) determining whether the toner adhesion amounts of the plural color toners are normal or abnormal according to results of the detecting step.

5 Claims, 10 Drawing Sheets

TONER ADHESION AMOUNT DETECTING APPARATUS FOR AN IMAGE FORMING APPARATUS

BACKGROUND OF THE INVENTION

The present invention relates to a color image recording apparatus to which a developing method is adopted, in which a two-component developer composed of toner and carrier is used, and by which a plurality of color images are recorded. Further, the present invention relates to a toner adhesion amount detecting method by which a desired color reproduction can be easily determined, and to an image forming method by which processing operations according to the results by the detection method are conducted.

In conventional color image recording apparatuses, developing units in which yellow, magenta, cyan and black developers are loaded are provided. In this case, when each color developer is initially loaded in the developing unit, there is a slight difference among toner charging amounts of each developer.

However, in the color image recording apparatus, a developing sleeve and a mixing unit in the developing unit are continuously rotated to simplify control operations, and consumed amounts of color developers are not always uniform but different each other. Therefore, a difference among mixing times of color developers loaded in the developing units occurs during copying operations. Accordingly, a difference in toner charging amounts is caused among developers. The difference in charging amounts exerts a bad influence upon the developing property.

That is, the developing property is due to the force (developing force) which is obtained from the following: the adhesive force (Coulomb's force) of toner and carrier and the adhesive force of developer to a developing sleeve are subtracted from the force due to the electric field caused by an electrostatic latent image.

In this case, there is a tendency that: Coulomb's force is remarkably increased as compared with other forces when a toner charging amount Q/m is increased.

Accordingly, when the toner charging amount is increased, the developing force is decreased. When the toner charging amount is decreased, the developing force is increased. When multi-colors are reproduced, each color can not obtain a desired toner adhesion amount due to the difference of the toner charging amount among color developers, and therefore color balance of a reproduced image is deteriorated, which is a problem.

On the other hand, there is a color image recording apparatus to which an image forming process [hereinafter, called a KNC (Konica New Color) process] is adopted, in which a plurality of toner images are superimposed on a photoreceptor so that a toner image made of plural layers is formed.

The KNC process is conducted in the following manner: charging, exposing and developing processes are repeated on one photoreceptor plural times corresponding to the number of colors so that a toner image composed of a plurality of layers and colors can be formed.

In this case, after the first cycle of charging, exposing and developing processes have been conducted, when charging processes of the second cycle and following cycles are conducted, electric potential after the exposing process is fluctuated due to the toner layer formed on the photoreceptor in the preceding cycle. This is due to the following: exposing light scatters on the surface of toner particles; and it is reflected on the interface of lumps of toner particles, so that the light does not arrive at the surface of the photoreceptor drum under the toner layers. As a result of the foregoing, in the exposing process, the difference of the photoreceptor surface potential is caused between a toner adhered portion and a toner non-adhered portion of the photoreceptor, and therefore, in the second developing process and after that, color phase and density are deviated, which is a problem.

Therefore, when considering the relation between the color toner charging amount and the toner adhesion amount, there is a problem that color balance is unstable from the reason that a desired toner adhesion amount can not be obtained in the KNC process.

On the other hand, conventionally the toner adhesion amount has been detected in the following manner: a reference toner image is individually formed of a plurality of color toners; and each color toner adhesion amount is detected. However, in the foregoing, only whether one color toner image forming conditions are normal or abnormal is detected. In the case where a plurality of color toners are superimposed so that a multi-color image can be formed, when one color toner adhesion amount is normal, and other toner adhesion amounts are abnormal; that is the case when adhesion amounts of all color toners are normal, or when at least some of the color toners are not abnormal, accurate toner image forming conditions can not be determined.

Further, the detection is conducted by a plurality of sensors or by replacing filters, and therefore, the apparatus becomes complicated, so that units or devices can not be disposed around the photoreceptor.

Reference toner images are respectively formed on different positions on the photoreceptor, and therefore, the image forming conditions are not uniform, and accuracy of the toner adhesion amount detection is lowered.

Further, when a plurality of light emitting elements and light receiving elements are used, adjustment for dispersion of light emitting amounts and spectral sensitivity characteristics of the elements are necessary, it takes a long period of time, and the accuracy is lowered.

The object of the present invention is to solve the above-described problems and to provide a color reproduction determination method by which, with respect to a multi-color image which is formed by superimposing a plurality of color toners, whether a desired color reproduction can be obtained or not can be easily determined.

Further, another object of the present invention is to provide an image forming method by which adjustment is conducted so that proper process conditions can be obtained, and preferable color reproduction can be maintained.

SUMMARY OF THE INVENTION

The object of the present invention is accomplished by the following method: when plural reference latent images, formed at the same position on the photoreceptor, are successively developed with different color toners so as to form a reference color toner image by superimposing the plural color toner images; an adhesion amount of each color toner is detected by a detecting unit every time the color toner image is developed; and whether the toner adhesion amounts are determined normal or abnormal by repeatedly detecting the adhesion amount of a color toner image in plural times.

Further, in the present invention, when the toner adhesion amount is determined to be normal from the result of the detection of the toner adhesion amount, an ordinary image forming process is conducted.

DETAILED DESCRIPTION OF THE INVENTION

Figure 1:
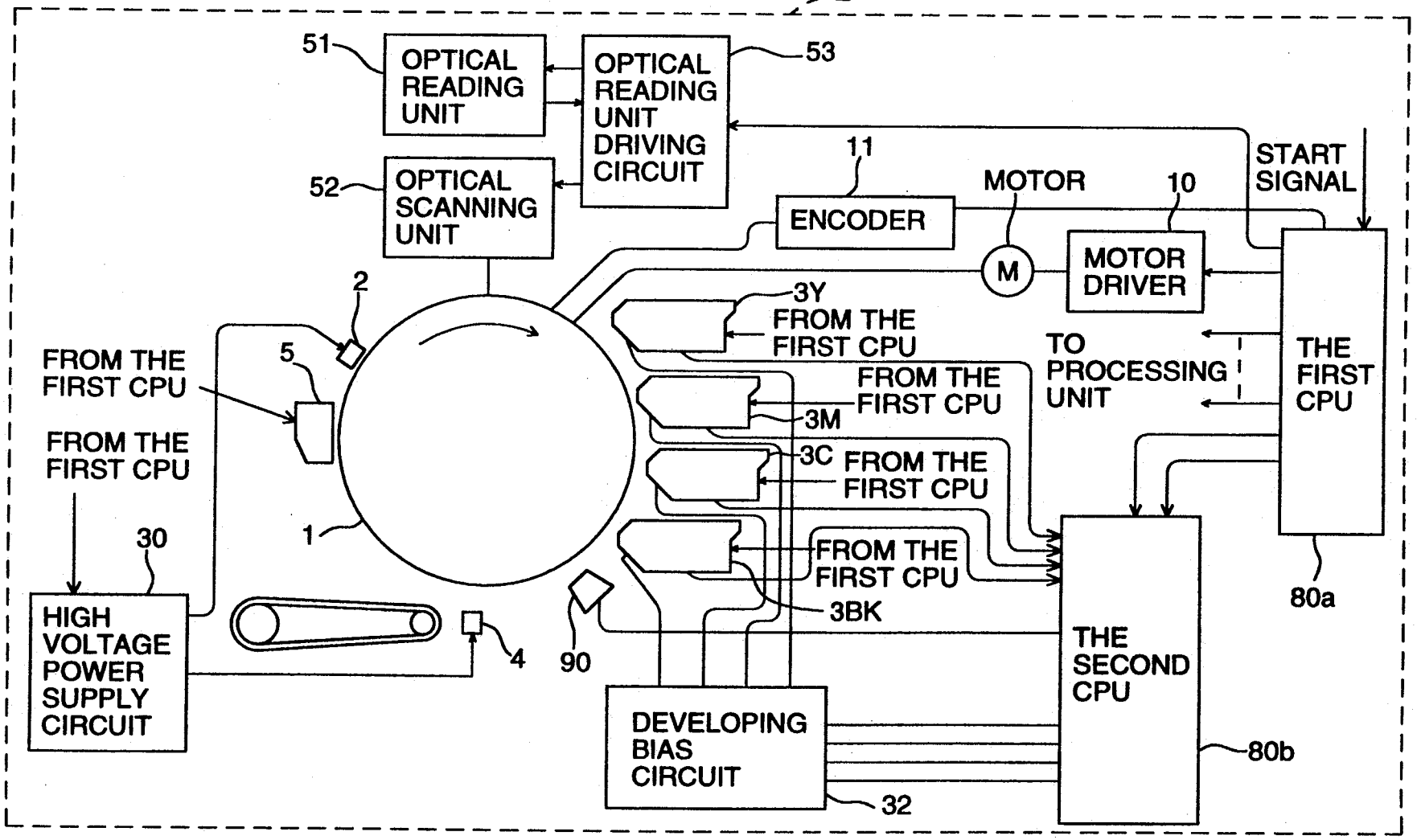
FIG. 1 is a schematic illustration of the structure of an image recording apparatus to which the toner amount detection method of the present invention is applied.

FIG. 1 is a block diagram showing an example of an image recording apparatus to which the present invention is applied.

Figure 2:
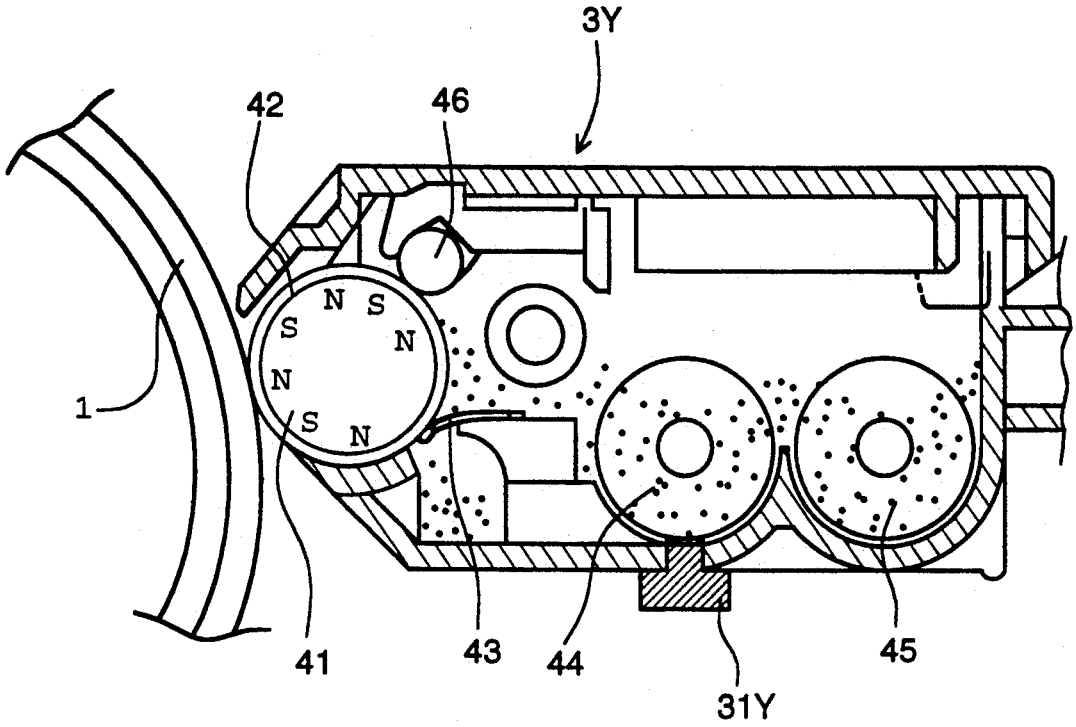
FIG. 2 is a view showing the internal structure of a developing unit.

An image recording apparatus 100 is composed of: a latent image carrier 1, charger 2, a motor driver 10, an encoder 11, developing units 3Y, 3M, 3C, 3BK, a developing bias circuit 32, toner density detecting units 31Y (refer to FIG. 2), 31M, 31C, 31BK, a transfer unit 4, a cleaning device 5, a high voltage power supply circuit 30, CPUs 80*a*, 80*b*, a reflection density detecting unit 90, an optical reading unit 51, an optical scanning unit 52 and an optical scanning unit driving circuit 53. When a copy button (not shown in the drawing) is pressed, the following operations are conducted: a light beam is emitted from an optical scanning unit by an image signal corresponding to an image density of an original image according to a timing signal outputted from the first CPU 80*a*; the light beam irradiates the latent image carrier 1; an electrostatic latent image is formed on the photoreceptor surface of the latent image carrier 1; the electrostatic latent image formed on the surface of the latent image carrier 1 is developed by developing units 3Y, 3M, 3C, 3BK so as to visualize the image as a multicolor toner image; and the transfer unit 4 is discharged according to a registration signal so that the toner image is transferred onto a transfer sheet. After that, the transfer sheet is fixed and the image is formed into a preservable reproduction image.

A drum-shaped conductive support, made of aluminum, the diameter of which is 150 mm, is used for the latent image carrier 1. The latent image carrier 1 is an OPC photoreceptor (hereinafter, called a photoreceptor drum) structured in the following manner: an intermediate layer, made of ethylene vinyl acetate copolymer, the thickness of which is 0.1 μm, is provided on the support; and a photosensitive layer, the thickness of which is 35 μm, is provided on the intermediate layer. When a light beam is irradiated on the surface of the photosensitive layer, its surface potential is lowered. Accordingly, after the photoreceptor drum has been uniformly charged previously to a predetermined potential, when a light beam is irradiated according to the color density of a document image, the surface potential of the photoreceptor drum is not uniform, and thereby a portion, the surface potential of which is lowered, can be formed. This portion is called an electrostatic latent image. The latent image carrier is not limited to the foregoing, but it may be a photoreceptor having another structure, such as a photoreceptor made of amorphous silicon. The latent image carrier is not limited to a drum-shaped one, but it may be a belt-shaped one. A drum-shaped OHP photoreceptor will be explained in the example.

The motor driver is a circuit by which a main motor (not shown in the drawing) to rotate the photoreceptor drum 1, is mainly controlled, and the number of rotation and the rotation of the main motor is ON-OFF controlled according to a control signal outputted from the first CPU 80*a*. The encoder 11 generates a pulse signal having a predetermined width corresponding to a rotational phase of the photoreceptor drum 1. Thereby, the first CPU 80*a* detects the rotational phase of the photoreceptor drum 1.

The developing units 3Y (refer to FIG. 2), 3M, 3C, 3BK only have different developer components to be loaded therein, and they are mechanically structured in the same manner. As a representative example, the developing unit 3Y will be explained hereinafter.

The developing unit 3Y is provided with a sleeve 42, in which a magnet roller 41 having N and S poles in the developer layer is incorporated, the first and second screw-shaped mixing rollers 44, 45, and a regulation member 43, by which the thickness of the developer layer on the sleeve 42 is regulated.

The first mixing member has a shape by which the developer is conveyed to the viewer's side, and the second mixing member has a shape by which the developer is conveyed to the side opposite to the viewer. Further, the developing unit is structured in the manner that the developer can be smoothly circulated and does not partially remain when a wall is provided between the first and second mixing members.

A scraper 46 is rotatable and roller-shaped, and is provided in the developing unit so that it is pressure-contacted with the sleeve, and scrapes the developer, in which toner has been consumed when the developer has passed through a developing area, from the sleeve. Due to the foregoing, the developer, which has been conveyed to the developing area, can be replaced with a new developer, so that the developing conditions can be stable.

The sleeve 42 is provided with a developing bias circuit 32 by which voltage having a DC bias component is impressed through a protective resistor so that the toner corresponding to the latent image can be adhered, and fogging on the background can be prevented.

The developing bias circuit 32 is provided with an AC power supply, by which an AC bias voltage is impressed, so that it can oscillate the toner between the sleeve and the photoreceptor drum 1, and a high voltage DC power supply, by which a DC bias voltage is impressed. In the developing bias circuit 32, a developing bias voltage $V_B$ can be changed by three steps, that is, $V_{B1}$, $V_{B2}$, $V_{B3}$, according to a control signal outputted from the CPU 80*b*. In the present invention, a reversal developing method is used. Accordingly, the developing bias voltage $V_{B1}$ has the potential difference of about 150 V from an initial charging potential voltage $V_H$ so that the toner can be adhered corresponding to the electrostatic latent image, fogging can be prevented, and accurate development can be conducted. The developing bias voltage $V_{B2}$ has the same value as the initial charging potential voltage $V_H$ so that the developing properties can be enhanced. The developing bias voltage $V_{B3}$ has the potential voltage by which the developing properties are lowered in relation with the initial charging potential voltage $V_H$.

Figure 3:
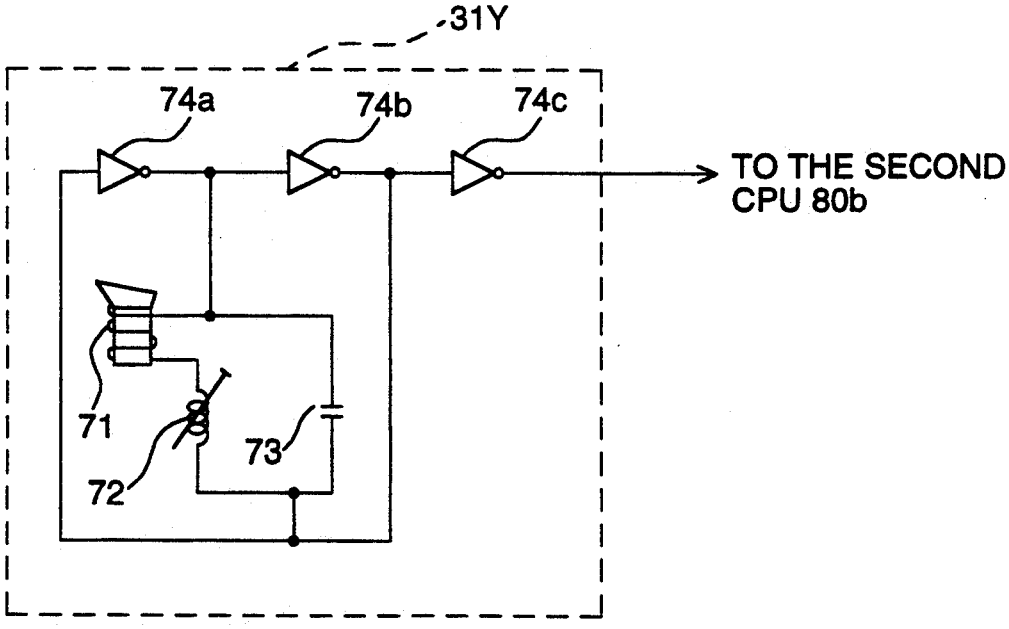
FIG. 3 is an electric circuit of an example of the toner density detection unit of the present invention.

The toner density detection units 31Y, 31M, 31C, 31BK are units by which a change of the transmission ratio of the developer is detected, and by which the toner density in developers loaded in developing units 3Y, 3M, 3C, 3BK is detected. They may be units by which the levels of developers loaded in the developing units 3Y, 3M, 3C, 3BK, expressing the volumes of the developers, are detected. The detection unit is not limited to the above-described one, but for the convenience of explanation, the toner density detection unit by which the toner density is detected when the transmission ratio is changed will be described hereinafter. As shown in FIG. 3, the toner density detection unit, for example, 31Y is composed of: a toner density detection coil 71; a variable inductance 72 for adjusting the oscillating frequency, which is connected in series with the coil 71; a capacitor 73 which is connected in parallel with the serial circuit, and by which a resonance circuit is formed, wherein the coil 71 and the variable inductance 72 are also used in the resonance circuit; and an oscillator composed of inverters 74*a*, 74*b*, 74*c*. The coil 71 is provided in a developer circulation path in a tank in the developing unit. The developer passes through the coil 71.

Developer carrier is made of a magnetic substance, and a toner is made of a non-magnetic substance. Therefore, inductance of the coil changes in the following manner: an amount of the magnetic substance passing through the coil is changed corresponding to the toner density change of the developer passing through the coil; and the inductance of the coil is changed due to the change of its permeability. The relation between the toner density and the oscillation frequency can be approximated to the linear function as widely known, and therefore, when the characteristics of the two-component developer are detected, the toner density of the developer can be detected.

A high voltage driving power supply circuit 30 is a circuit by which a predetermined high voltage is impressed upon the transfer unit 4 and charger 2. The charger 2 and the transfer unit 4 are preferably a corona charger and a corona transfer unit in which corona discharging is conducted, but are not limited to them when the discharging efficiency is uniform.

The first CPU 80*a* sequentially controls the image forming means, and an image forming program, by which image forming processes are conducted, is incorporated in the microcomputer. The first CPU 80*a* starts the image forming program to conduct the image forming processes by a start signal outputted when the copy button is pressed. The first CPU 80*a* stores the toner density control program in a ROM, and controls the toner density as follows. When the toner density program is started as described later, for example, while the image forming processes are being conducted, the first CPU 80*a* controls each color toner density in the manner that: the toner density is maintained to be almost constantly a predetermined value according to signals outputted from the toner density detection units 31Y, 31M, 31C, 31BK.

An optical reading unit 51 is composed of: not shown in the drawings, an illumination lamp integrally structured with a first scanning mirror; and a second mirror, for example, a V mirror, which is moved at a speed ratio of ½ of the first mirror, and it scans the document while the optical length from the front of the lens is maintained to be always constant. Due to the foregoing, the optical reading unit 51 forms an image from the reflection light reflected from the document image on a platen glass in an optical receiving section of a solid state image pick-up element. The optical reading unit 51 sends an output signal from the solid state image pick-up element to an image processing circuit (not shown in the drawings) in an optical reading unit driving circuit 53.

An optical scanning unit 52 is composed of an optical laser unit and a stationary scanning unit using an LED array and a liquid crystal, wherein the optical laser unit is provided with a polygonal mirror with which laser beams emitted from a semiconductor laser and modulated by the image signal conduct rotational-scanning.

The optical reading unit driving circuit 53 has a circuit by which the mechanical unit of the polygonal mirror or the like is controlled, and the image processing circuit by which the image signal from the optical reading unit 51 is color-processed, and, for example, stores reference image data, which changes by steps from the optical reflection density of 1.0 to 0 or continuously, in the ROM. The reference latent image is formed according to the data. In the above-described example, the reference image density data corresponds to the optical reflection density of 0.8, but it is not limited to that density, and can optionally select the density of 1.0 to 0. The ROM corresponds to a reference image signal generation circuit.

Figure 4:
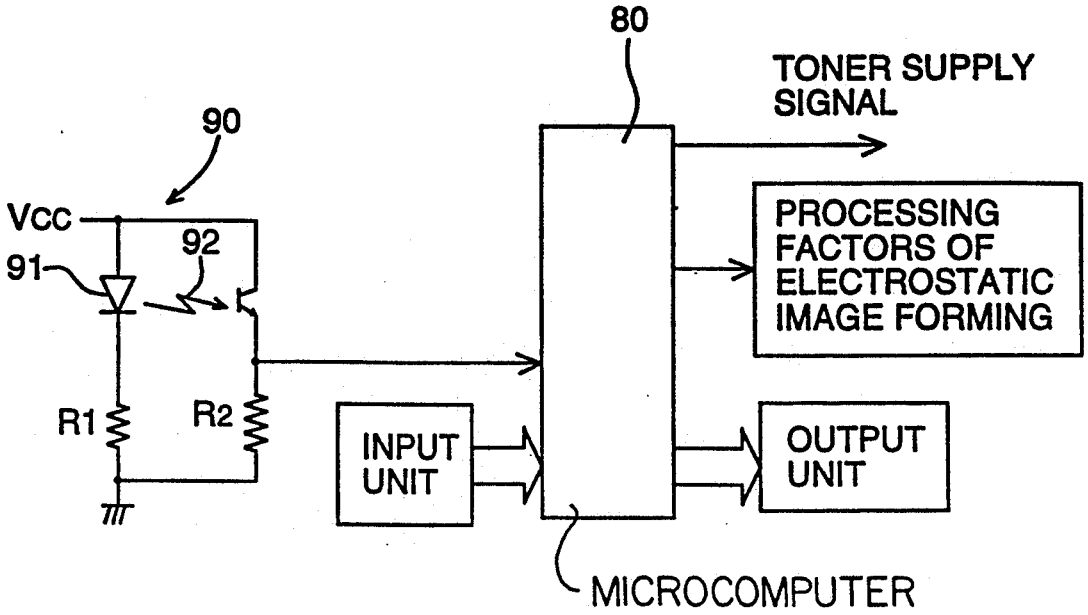
FIG. 4 is a block diagram showing the basic structure of the present invention.
Figure 5:
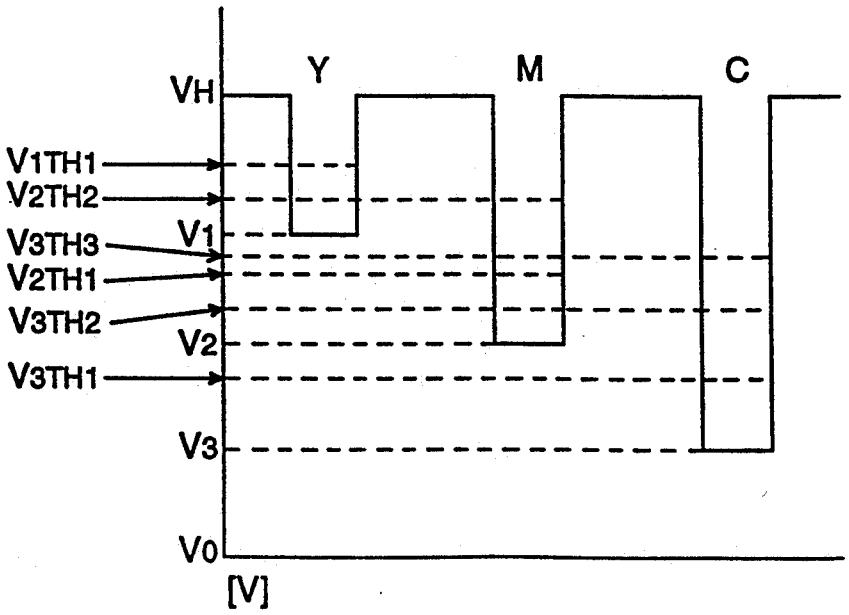
FIG. 5 is a graph by which the concept of the determination level of the present invention is explained.
Figure 6:
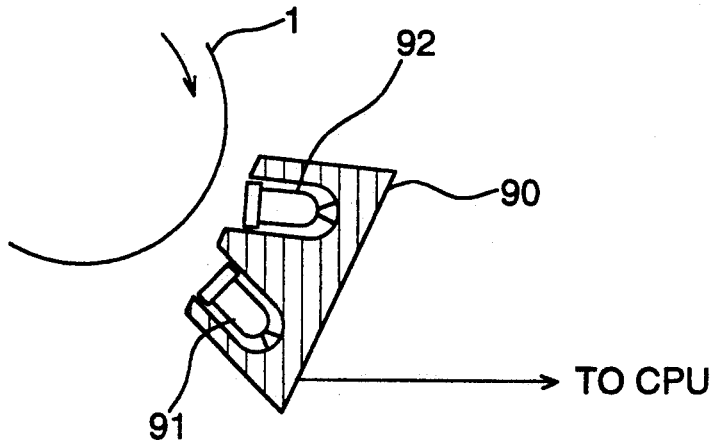
FIG. 6 is a schematic illustration of the structure of an example of a reflection density detection unit of the present invention.

Referring to FIG. 4, FIG. 5 and FIG. 6, the structure of an example of a toner adhesion amount detection unit of the present invention will be described as follows.

FIG. 4 is a block diagram showing an example of the toner adhesion amount detection unit of the present invention. FIG. 5 is a graph in which the concept of a determination level used in the example is explained. FIG. 6 is a view showing a general structure of a reflection density detection unit of the example.

The toner detection unit is composed of an optical reflection density detection unit 90 and a microcomputer 80 by which a control and determination are conducted, as shown in FIG. 4.

The reflection density detection unit 90 is structured as shown in FIG. 6 in the manner that: a light emitting element 91 such as an LED and a light receiving element 92 which receives the reflection light from the photoreceptor drum 1, are separately housed in a casing which is separated by a wall, and thereby irregularly reflected light from the subject can not be received. The reflection density detection unit 90 has the light emitting element 91, the light receiving element 92, resistors R1, R2 and a power supply voltage $V_{cc}$, and the output voltage from the light receiving element 92 is supplied to the microcomputer 80. When the photoreceptor drum 1 is rotated, the reference toner image is moved to the position almost opposite the light emitting element 91 and light receiving element 92, the light emitting element 91 emits the light, and the light receiving element 92 outputs a voltage corresponding to the density of the reference toner image. Accordingly, when a reference latent image, which is formed in the manner described later, is passed through the developing units 3C, 3M, 3Y, the reference toner image is formed, the light emitting element 91 emits the light, and the light from the reference image side is projected into the light receiving element 92. The output of the light receiving element 92 corresponds to the density of the reference toner image.

The microcomputer 80 is a control unit which controls image forming process elements as described above so that image forming processes can be conducted, however, in this case, it is used for the toner adhesion amount detection, that is, the color balance discrimination. The microcomputer stores a program, by which whether the toner adhesion amounts of Y, M, C are normal or not, is determined, that is, a color balance determination program in the ROM. When the color balance determination program is started, which will be described later, a cycle composed of charging, exposing, and developing processes is repeatedly conducted, so that a toner image made of a plurality of toner layers is formed by successively superimposing reference color toner images on the photoreceptor drum 1. In this case, after each cycle has been completed, that is, whenever the reference toner image on the photoreceptor 1 has passed through the developing units 3C, 3M, 3Y, each color toner adhesion amount is detected by an output from the reflection density detection unit 90. That is, whenever the photoreceptor drum 1 is rotated one rotation, each one of the toner adhesion amounts of Y, M, C is detected by the reflection density, so that the condition of each color toner image formation is recognized.

The color balance determination program has a plurality of toner adhesion amount determination level data shown in FIG. 5. Referring to FIG. 5, the toner adhesion amount determination level will be described as follows.

The color balance determination data $V_H$ corresponds to the maximum output voltage outputted from the light receiving element 92, and the output obtained when the light is totally reflected from the surface of the photoreceptor drum 1. The surface of the photoreceptor drum 1 is chromatic, for example, blue or the like, and glossy. The wavelength of the light emitted from the light emitting element 91 is preferably the wavelength which is common to yellow, magenta, and cyan color toners, and the spectral reflection factor of which is low. Further, it may be the wavelength, the spectral reflection factor of which is low, and which is common to two of yellow, magenta, and cyan color toners. Preferably, the light receiving element 92 is highly sensitive to the wavelength.

The toner adhesion amount determination data $V_0$ is obtained when the light amount reflected from the surface of the photoreceptor drum 1 is 0.

In the first toner layer, a threshold value $V_{1H1}$ is set. The data valued from $V_1$ to $V_{1TH1}$ is corresponding to the case where the toner adhesion amount of the first color is normal in the first layer, and the data from $V_{1H1}$ to $V_H$ is corresponding to the case where the toner adhesion amount of the first color is abnormal.

In the second toner layer, two threshold values are set. The data valued from $V_2$ to $V_{2TH1}$ is corresponding to the case where both the toner adhesion amount of the first color in the first layer, and that of the second color in the second layer are normal, and the data from $V_{2TH1}$ to $V_{2TH2}$ is corresponding to the case where one of the toner adhesion amounts of the first and second colors is normal and the other is abnormal. The data valued from $V_{2TH2}$ to $V_H$ is corresponding to the case where both of the toner adhesion amounts of the first and second colors are abnormal.

In the third toner layer, three threshold values of $V_{3TH1}$, $V_{3TH2}$, and $V_{3TH3}$ are set. The data valued from $V_3$ to $V_{3TH1}$ is corresponding to the case where the toner adhesion amount of the first color in the first layer, that of the second color in the second layer, and that of the third color in the third layer are all normal. The data from $V_{3TH1}$ to $V_{3TH2}$ is corresponding to the case where one of the toner adhesion amounts of the first, second and third colors is normal and other two of them are abnormal. The data from $V_{3TH2}$ to $V_{3TH3}$ is corresponding to the case where two of the toner adhesion amounts of the first, second and third colors are abnormal and the other one is normal. The data from $V_{3TH3}$ to $V_H$ is corresponding to the case where all of the toner adhesion amounts of the first, second, third colors are abnormal.

When it is determined that the toner adhesion amount is normal from the results of the above-described toner adhesion amount discrimination, the microcomputer 80 conducts image forming processes. However, when the toner adhesion amount is out of an allowable range, the microcomputer controls at least one of charging, exposing, and developing conditions, under which the abnormal toner image is formed, and the correct toner adhesion amount can be obtained. Alternatively, toner in the developing unit, corresponding to the layer of which the toner adhesion amount is out of the allowable range, is forcibly consumed. This is one of characteristics of the present invention.

In the example, toner is forcibly consumed when the output voltage from the developing bias circuit 32 is adjusted. However, the present invention is not limited to the foregoing, but the toner may be consumed when other electrostatic process conditions are adjusted.

Further, for the toner adhesion amount determination unit, the microcomputer, which conducts image forming processes, is not necessarily used, but other microcomputer may be provided. In this example, the toner adhesion amount determination method is explained as software, however, the present invention is not limited to this software, but it is easy for the ordinary skilled person in the art to realize it as hardware.

Figure 7:
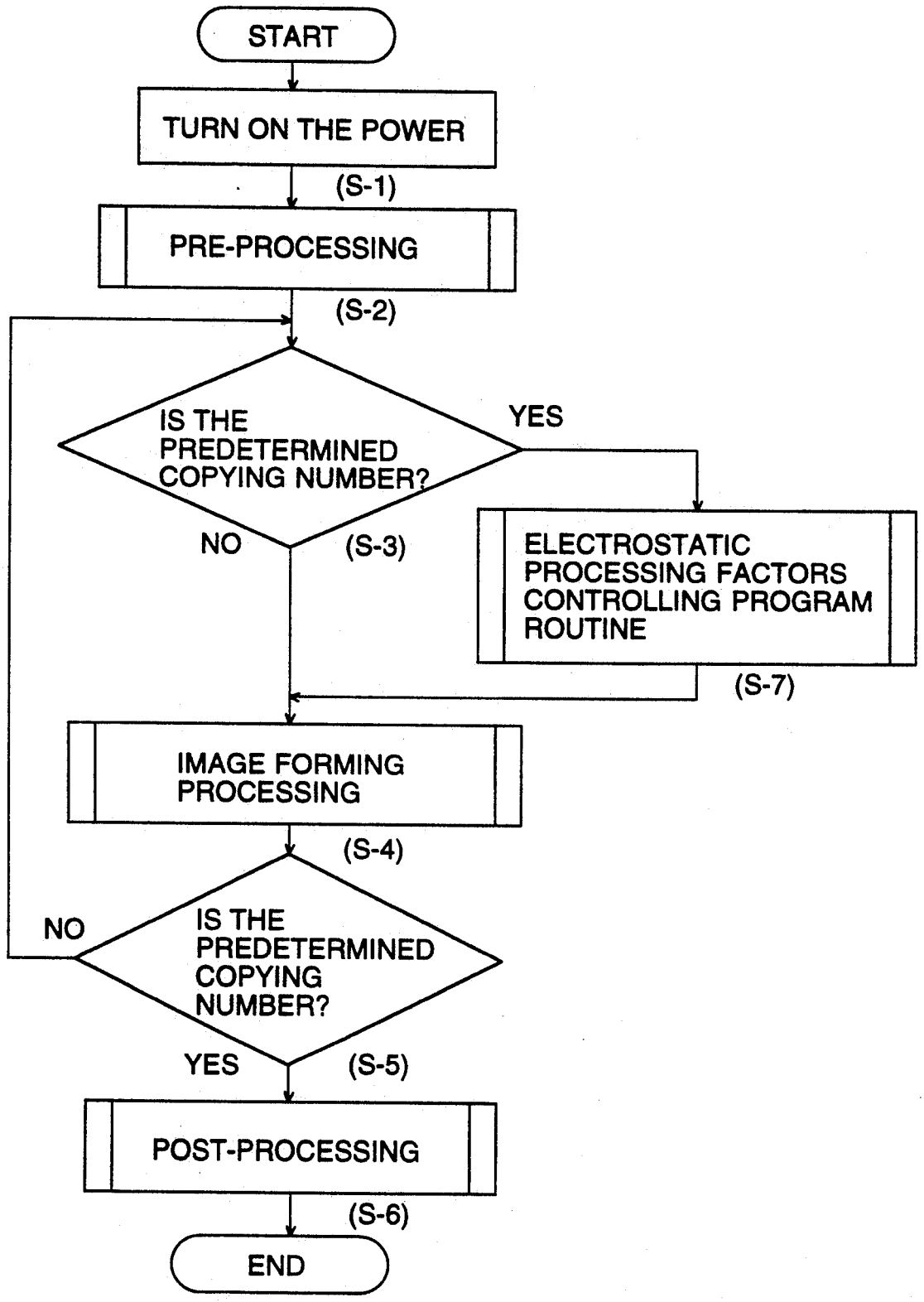
FIG. 7 is a flow chart showing operations of the present invention.

FIG. 7 is a flow chart showing various control operations of the image recording apparatus of the example. At first, when the power source of the image recording apparatus is turned on (S - 1), a pre-processing process is conducted (S - 2). After that, before image forming processing is conducted, it is determined whether the number of copying sheets is a predetermined number or not, for example, 3000×n (n is an integer). When the number of copying sheets is not a predetermined number, image forming processing is conducted (S - 4). After that, whether the predetermined number of copying sheets is reached to the predetermined number or not is determined (S - 5), and it is repeated until it is reached to the number. When image forming processing of the predetermined number has been completed, a post-processing process is conducted (S - 6) and completed.

Figure 8A:
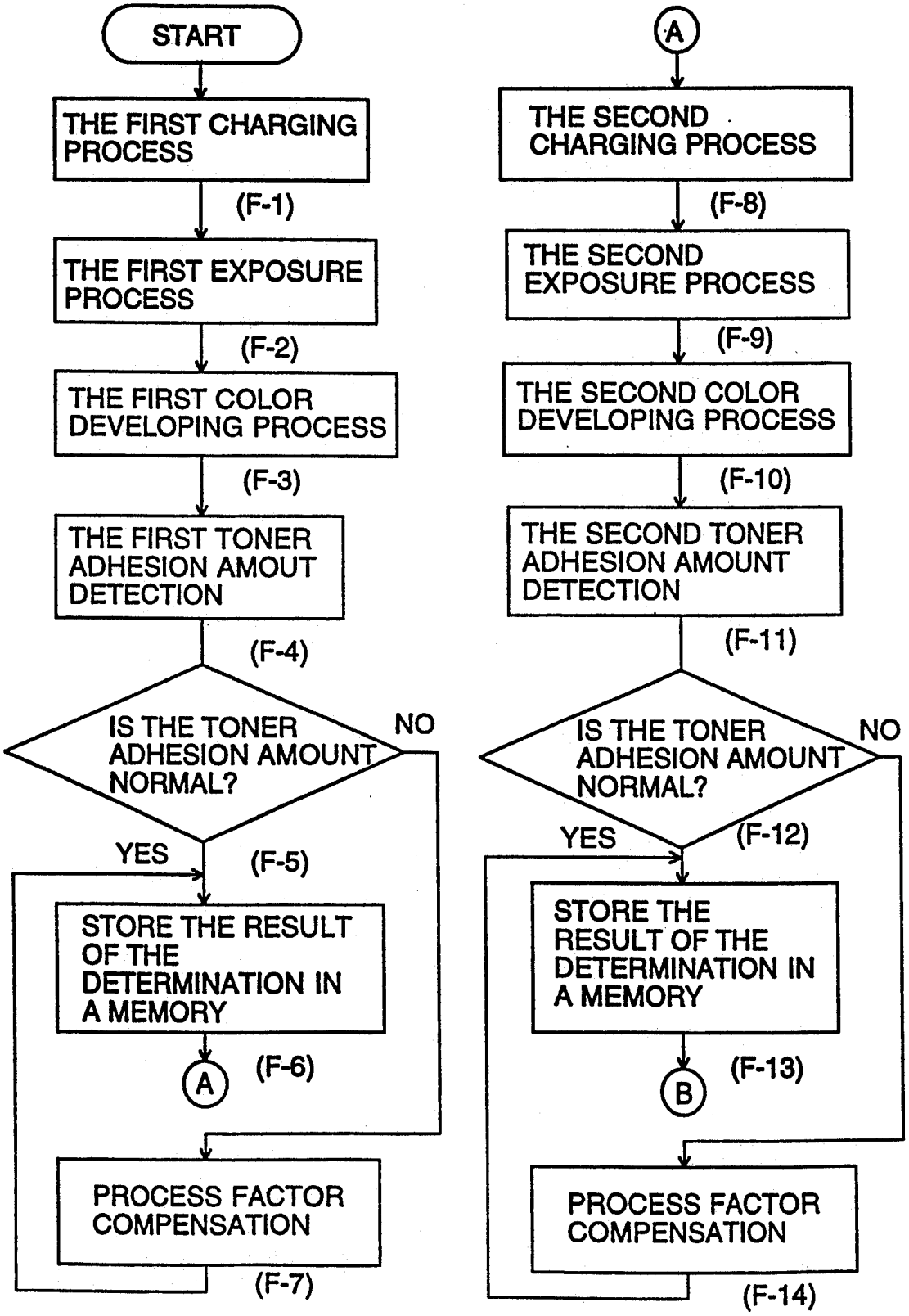
FIG. 8 is a schematic representation of the relationship of FIGS. 8-1 and 8-2 which together form a flow chart showing operations of an electrostatic process condition control program of the present invention.
Figure 8B:
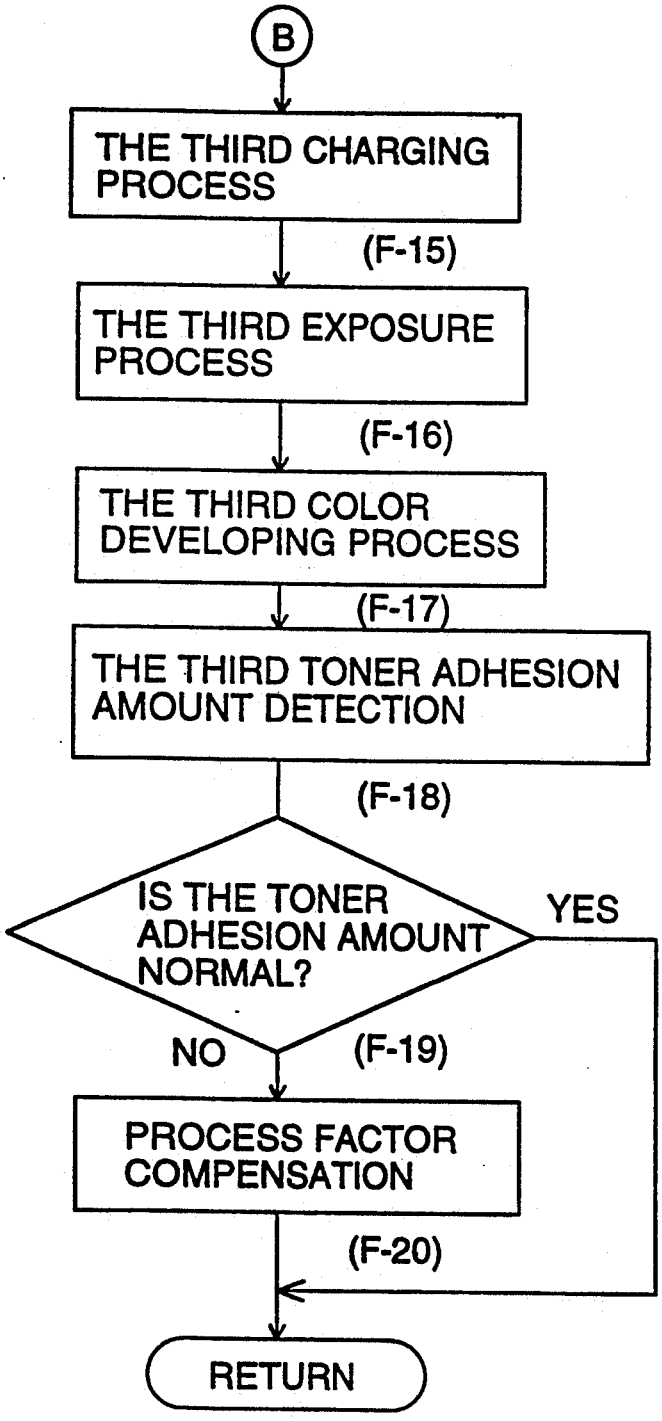

In the step (S - 3), when the number of copying sheets is a predetermined number, the program sequence enters a electrostatic processing factor controlling program routine (S - 7) as shown in FIG. 8.

In FIG. 8, at first, the first charging process is conducted (F - 1), the first exposure process is conducted (F - 2), the first color developing process is conducted (F - 3), and the first toner adhesion amount detection is conducted (F - 4). In this case, whether the toner adhesion amount is normal or abnormal is determined according to the toner adhesion amount determination explained in FIG. 4 and FIG. 5 (F - 5). That is, when the result of the toner adhesion amount detection is from $V_1$ to $V_{1H1}$, it is determined that the toner adhesion amount of the first color is normal, the result of the determination is stored in a memory (F - 6), and the program sequence advances to the second process. When the toner adhesion amount detection is from $V_{1TH1}$ to $V_H$, it is determined that the first color is abnormal, the sequence enters into the process factor compensation process (F - 7), and the processes are controlled so that the toner adhesion amount of the first color can be appropriate. The result of the determination is stored in the memory (F - 6), and the sequence advances to the second process.

Next, the second charging process (F - 8), the second exposure process (F - 9), the second color developing process (F - 10), and the second toner adhesion amount detection (F - 11) are conducted. Here, whether the toner adhesion amount is normal or abnormal is determined (F - 12). That is, when the result of the toner adhesion amount detection is from $V_2$ to $V_{2TH1}$, both the adhesion amount of the first color and that of the second color are normal. Therefore, it is determined that the toner adhesion amount of the second color is normal, the result of the determination is stored in the memory (F - 13), and the sequence advances to the third process. When the result of the toner adhesion is from $V_{2TH1}$ to $V_{2TH2}$, one of the toner adhesion amount of the first color or that of the second color is abnormal. From the result of the determination stored in the step (F - 6), when the first color is abnormal, the second color is determined to be normal, the result of the determination is stored in the memory (F - 13), and the sequence advances to the third process. Inversely, when the first color is normal, it is determined that the second color is abnormal, the program sequence enters into the process factor compensation process (F - 14), and the processes are controlled so that the toner adhesion amount of the second color can be appropriate. The result of the determination is stored in the memory (F - 13), and the sequence advances to the third process. When the result of the toner adhesion amount detection is from $V_{2TH2}$ to $V_H$, both the adhesion amount of the first color and that of the second color are abnormal. Accordingly, it is determined in the step (F - 12) that the second color is abnormal, the sequence enters into the process factor compensation process (F - 14), and the processes are controlled so that the toner adhesion amount of the second color can be appropriate. Then, the result of the determination is stored in the memory (F - 13), and the sequence advances to the third process.

Finally, the third charging process (F - 15), the third exposure process (F- -16), the third color developing process (F - 17), and the third toner adhesion amount detection (F - 18) are carried out. Here, whether the toner adhesion amount is normal or abnormal is determined (F - 19). That is, when the result of the toner adhesion amount detection is from $V_3$ to $V_{3TH1}$, the toner adhesion amount of the first color, that of the second color, and that of the third color are all normal, it is determined that the adhesion amount of the third color is normal, and the sequence enters into the image forming process in the step (S - 4). When the result of the toner adhesion amount detection is from $V_{3TH1}$ to $V_{3TH2}$, one of the toner adhesion amounts of the first, second and third colors is abnormal. From the result of the determination stored in the step (F - 6) and the step (F - 13), when the adhesion amount of the first color or the second color is abnormal, it is determined that the the adhesion amount of the third color is normal, and the sequence enters into the image forming process in the step (S - 4). When the adhesion amount of the first color and that of the second color are normal, it is determined that the adhesion amount of the third color is abnormal, the sequence enters into the process factor compensation process (F - 20), and the processes are controlled so that the toner adhesion amount of the third color can be appropriate. When the result of the toner adhesion amount detection is from $V_{3TH2}$ to $V_{3TH3}$, two of the adhesion amounts of the first, second and third colors are abnormal. From the result of the determination stored in the step (F - 6) and the step (F - 13), when the toner adhesion amount of the first color and that of the second color are abnormal, it is determined that the adhesion amount of the third color is normal, and the sequence enters into the image forming process in the step (S - 4). On the other hand, when the adhesion amount of the first color or that of the second color is abnormal, it is determined that the adhesion amount of the third color is abnormal, the sequence enters into the process factor compensation process (F - 20), and the processes are controlled so that the toner adhesion amount of the third color can be appropriate. Then, the sequence enters into the image forming process in the step (S - 4).

Figure 9A:
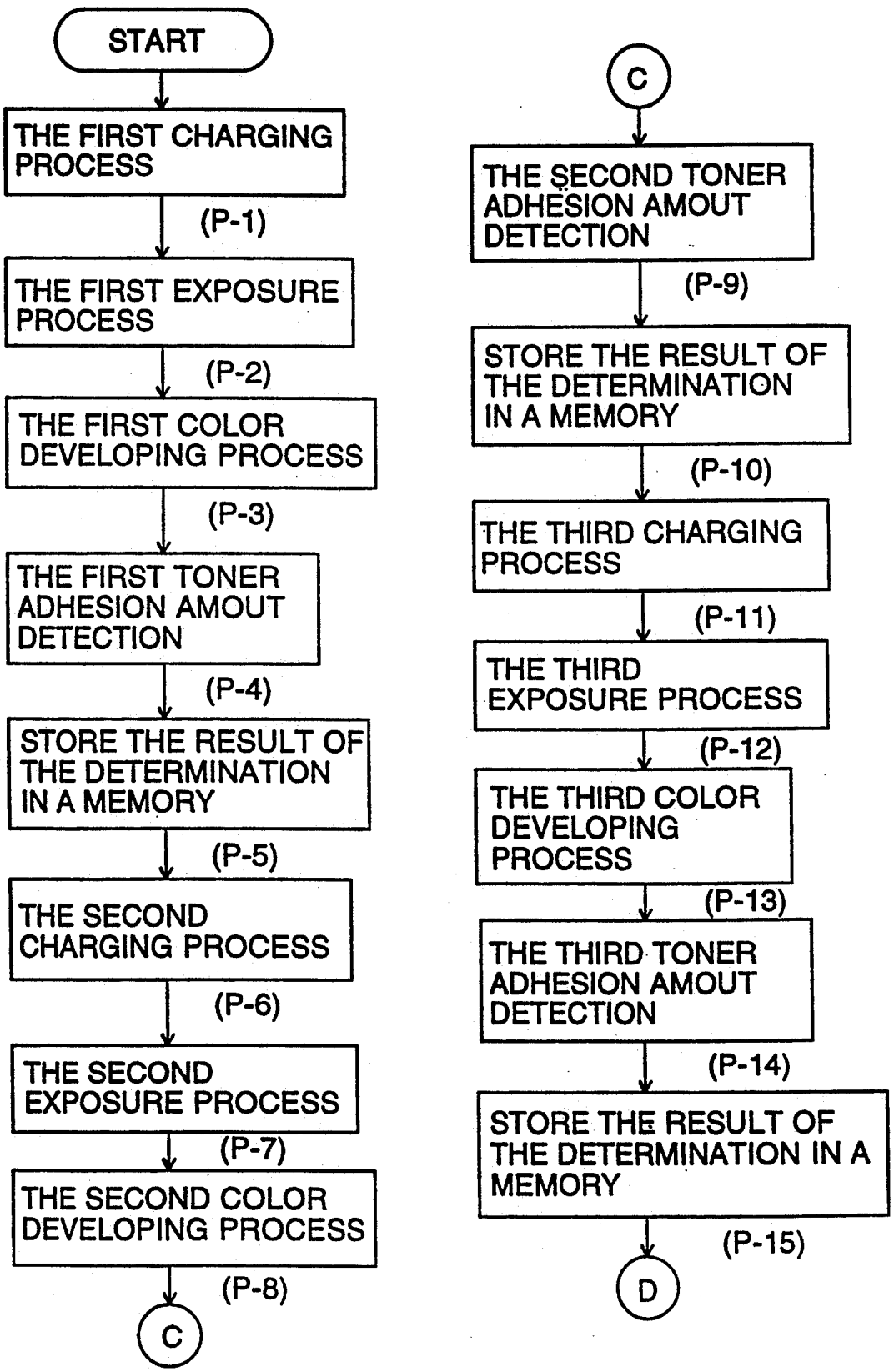
FIG. 9 is a schematic representation of the relationship of FIGS. 9-1 and 9-2 which together form a flow chart showing another example of operations of an electrostatic process condition control program of the present invention.
Figure 9B:
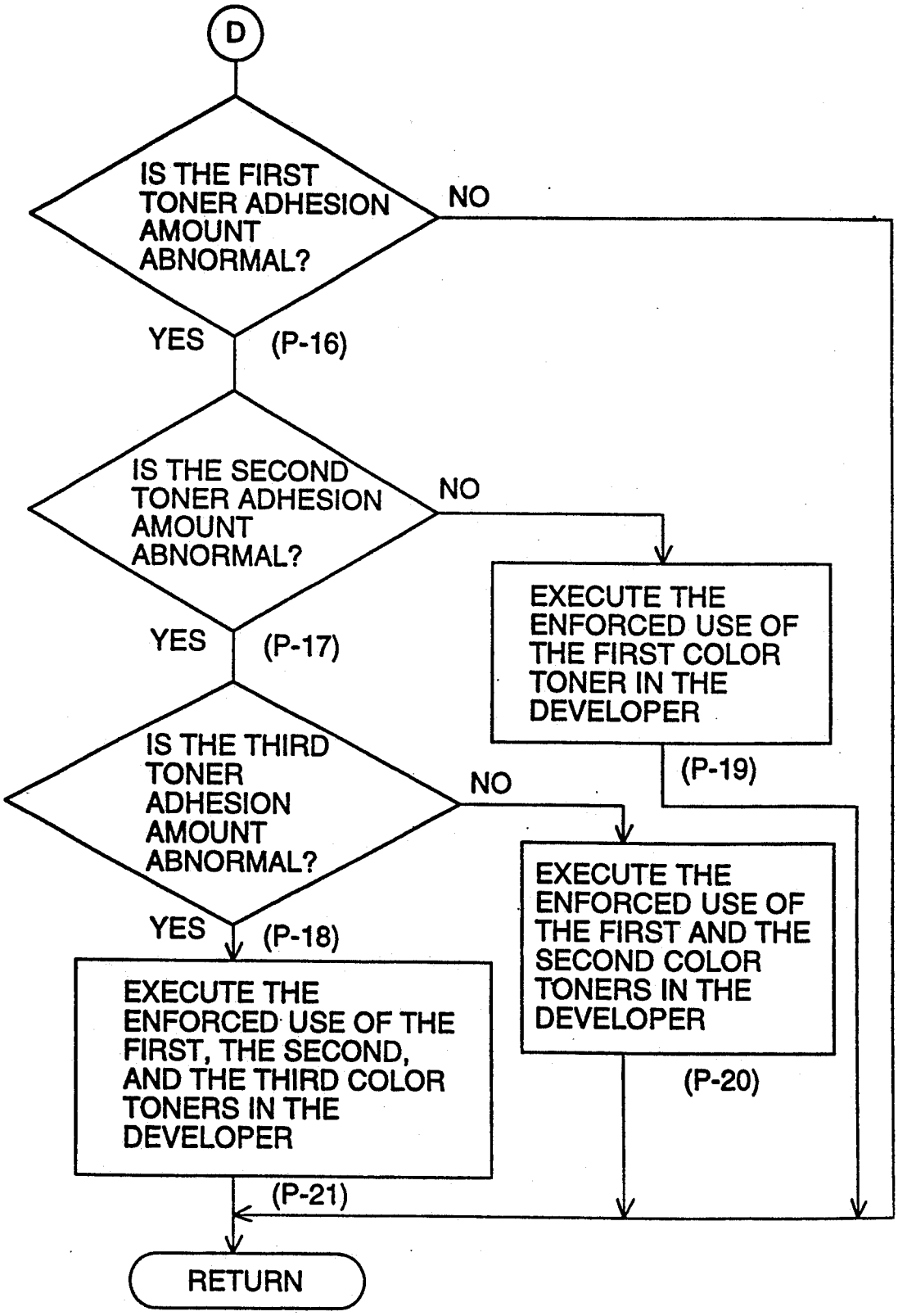

FIG. 9 is a flow chart showing another example, which is different from the example of the operations of the electrostatic processing factor controlling program routine (S - 7) in FIG. 8. The example is to form a image by successively superimposing the reference images from the first color to the third color on the photoreceptor drum, to detect the toner adhesion amount every time when the reference image is superimposed, and to store the detection result in the memory. Further, the example is to discriminate whether the toner adhesion amount is normal or abnormal, and then to make the toner in the developing unit, the adhesion amount of which is abnormal, forcibly consumed.

At first, in the same way as the example in FIG. 8, the first charging process is carried out with respect to the first color (P - 1), the first exposure process is carried out (P - 2), the first color developing process is carried out (P - 3), and the first toner adhesion amount is detected (P - 4). Here, it is not determined whether the toner adhesion amount is normal or abnormal, and the result of the toner adhesion amount detection is stored (P - 5). Next, the second charging process is carried out with respect to the second color (P - 6), the second exposure process is carried out (P - 7), the second color developing process is carried out (P - 8), the second toner adhesion amount detection is carried out (P - 9), and the result of the toner adhesion amount detection is stored in the memory (P - 10). Next, the third charging process is carried out with respect to the third color (P - 11), the third exposure process is carried out (P - 12), the third developing process is carried out (P- 13), the third toner adhesion amount detection is carried out (P - 14), and the result of the toner adhesion amount detection is stored in the memory (P - 15). Next, whether the result of the toner adhesion amount detection stored in the step (P - 5) is normal or not, is determined (P - 16). When the result of the first toner adhesion amount detection is not abnormal, the program sequence enters into the image forming process in the step (S - 4) of the image recording operation shown in FIG. 7. When the result of the first toner adhesion amount detection is abnormal, it is determined whether the result of the second toner adhesion amount detection stored in the step (P - 10) is abnormal or not (P - 17). When the result of the second toner adhesion amount is not abnormal, the enforced compensation cycle of the toner loaded in the first color developing unit is turned on (P - 19), and the sequence enters into the image forming process in the step (S - 4). When the result of the second toner adhesion amount detection is abnormal, it is determined whether the result of the third toner adhesion amount detection stored in the step (P - 15) is abnormal or not (P - 17). When the result of the third toner adhesion amount detection is not abnormal, the enforced compensation cycle of the toners loaded in the first and second color developing units is turned on (P - 20), and the sequence enters into the image forming process in the step (S - 4). When the result of the third toner adhesion amount detection is abnormal, the enforced compensation cycle of the toners loaded in the first, second, and third color developing units is turned on (P - 21), and the sequence enters into the image forming cycle in the step (S - 4). In the case of the example shown in FIG. 9, it is supposed that the toner compensation amount is previously determined in the enforced compensation cycle of the toner.

Figure 10:
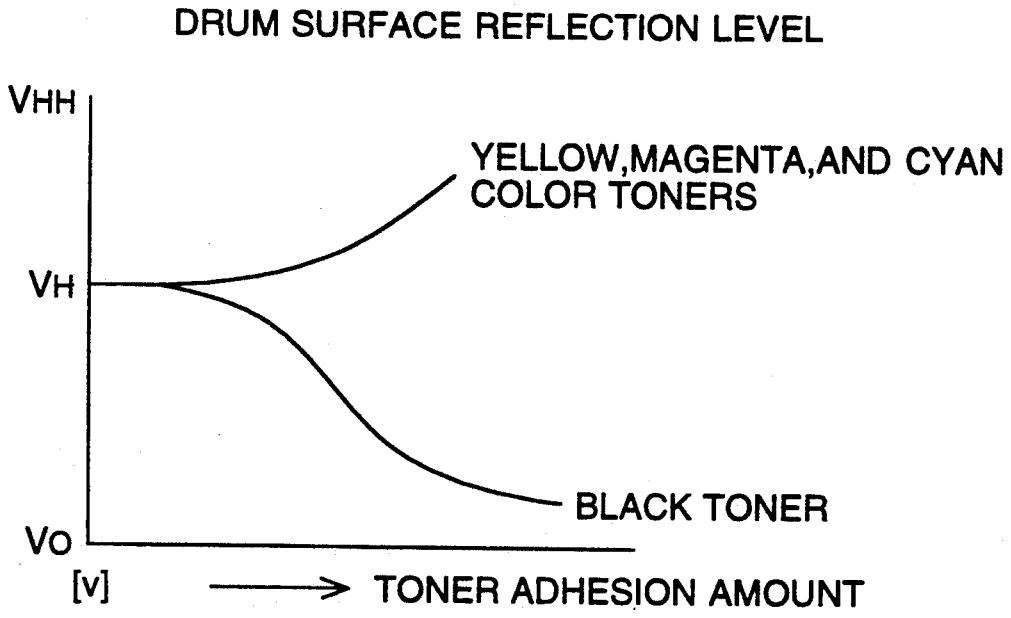
FIG. 10 is a graph by which another concept of the determination level of the present invention is explained.

FIG. 10 shows another concept of the determination level of the toner adhesion amount detection method.

This example shows the case where a larger light amount reflected from the drum surface on which toners are adhered is obtained by comparison to the light amount reflected from the drum surface on which toners are not adhered. When yellow, magenta, and cyan color toners are adhered on the drum surface, the output of a light receiving element 92 become large as shown by $V_H < V_{HH}$. On the other hand, in the example, the more the black toner adhesion amount is increased, the more the light amount reflected from the drum surface is decreased, that is, it is decreased in the direction shown by $V_H \rightarrow V_0$. These characteristics can be realized by selecting the spectral reflection factors of the toners, and spectral characteristics of the light emitting element and the light receiving element. In this case, the determination level of the color toner adhesion amount shown in FIG. 5 can be changed corresponding to the output of the light receiving element 92.

As described above, a multi-color image can be obtained according to the present invention in the following manner: when the multi-color image is formed by superimposing a plurality of color toners, the toner adhesion amount is detected every time each color is developed; the result of the detection is compared with reference data stored in the memory in advance and it is determined whether the result is normal or not; when the result of detection is abnormal, the processes are controlled so that the toner adhesion amount becomes appropriate; and therefore a multi-color image which can always maintain excellent color reproducibility can be obtained.

What is claimed is:

1. A method for determining toner adhesion amounts of a plurality of color toners on a toner image holding means, comprising the steps of:

forming a plurality of reference latent images, each of which is corresponding to a respective component color image of a reference toner image;

developing said reference latent images, each of which is developed with a respective color toner of the plurality of color toners, so that developed reference latent images are superimposed each at a time on the toner image holding means to form said reference toner image;

detecting the toner adhesion amounts of the plurality of color toners by detecting said reference toner image every time when one of said developed reference latent images is superimposed on a same portion of said toner image holding means; and determining whether said toner adhesion amounts of said plurality of color toners are normal or abnormal according to results of said detecting step.

2. The method of claim 1, wherein said detecting step includes an optical detection of said toner adhesion amounts of said plurality of color toners.

3. The method of claim 1, further comprising the step of:

compensating said toner adhesion amounts of said plurality of color toners according to a result of said determining step;

wherein said determining step respectively determines each one of said toner adhesion amounts, so that said compensating step respectively compensates each one of said toner adhesion amounts.

4. An apparatus for forming a color image on a photoreceptor, comprising:

means for forming a latent image corresponding to the color image, wherein said forming means forms a plurality of reference latent images on the photoreceptor, each of which is corresponding to a respective component color image of a reference toner image;

means for developing said latent image with a plurality of color toners, wherein said developing means develops said reference latent images, each of which is developed with a respective color toner of said plurality of color toners, so that developed reference latent images are superimposed each at a time on said photoreceptor to form said reference toner image thereon;

means for detecting the toner adhesion amounts of the plurality of color toners by detecting said reference toner image every time when one of said developed reference latent images is superimposed on said photoreceptor;

means for determining whether said toner adhesion amounts of said plurality of color toners are normal or abnormal according to results of detection by said detecting means; and a first controlling means for controlling the apparatus to form said color image when said determining means determines all of said toner adhesion amounts are normal.

5. The apparatus of claim 4, further comprising;

a second controlling means for respectively controlling each of toner consuming amounts of said plurality of color toners when said determining means determines respective one of said toner adhesion amounts of said plurality of color toners.

* * * * *